US009975369B2

(12) United States Patent
Doi

(10) Patent No.: US 9,975,369 B2
(45) **Date of Patent: *May 22, 2018**

(54) POWER CONTROL DEVICE, POWER CONTROL METHOD, AND RECORDING MEDIUM

(71) Applicants: KABUSHIKI KAISHA TOSHIBA, Tokyo (JP); TOSHIBA TEC KABUSHIKI KAISHA, Tokyo (JP)

(72) Inventor: Yohei Doi, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 17 days.

This patent is subject to a terminal disclaimer.

(21) Appl. No.: 15/418,059

(22) Filed: Jan. 27, 2017

(65) Prior Publication Data

US 2017/0136798 A1 May 18, 2017

Related U.S. Application Data

(63) Continuation of application No. 14/818,044, filed on Aug. 4, 2015, now Pat. No. 9,592,696.

(51) Int. Cl.
*B41M 7/00* (2006.01)
*B41J 29/393* (2006.01)

(52) U.S. Cl.
CPC ..... *B41M 7/0009* (2013.01)

(58) Field of Classification Search
CPC ... B41J 2/32; B41J 2/325; B41J 3/4075; B41J 15/04; B41J 2202/33; B41J 29/02; B41J 2/22; B41J 2/3351; B41J 29/393; B41J 2/33525
See application file for complete search history.

(56) References Cited

U.S. PATENT DOCUMENTS 7,952,599 B2 5/2011 Zhou et al.
9,592,696 B2 * 3/2017 Doi ..... B41M 7/0009

FOREIGN PATENT DOCUMENTS

JP H06-253454 9/1994

* cited by examiner

*Primary Examiner* — Lamson Nguyen
(74) *Attorney, Agent, or Firm* — Patterson & Sheridan LLP

(57) ABSTRACT

A power control device includes a heating section, an input section, and a control section. The heating section is configured to heat an object. The input section is configured to receive a power consumption value. The control section is configured to control the heating section so that a total power value obtained by adding a power consumption value of the heating section and the power consumption value received by the input section does not exceed a predetermined power value.

8 Claims, 6 Drawing Sheets

POWER CONTROL DEVICE, POWER CONTROL METHOD, AND RECORDING MEDIUM

CROSS-REFERENCE TO RELATED APPLICATION

This application is a continuation of U.S. patent application Ser. No. 14/818,044, filed on Aug. 4, 2015, the entire contents of each of which are incorporated herein by reference.

FIELD

Embodiments described herein relate generally to a power control device, a power control method, and a recording medium.

BACKGROUND

An image can be formed on a paper sheet using a decolorable color material, which allows the paper sheet to be reused by decoloring the image. A decoloring device can decolor the decolorable color material by applying high temperature on the paper sheet. The decoloring device can start a decoloring operation in response to the paper sheet being disposed in a decoloring tray.

However, when the decoloring device operates, total power consumption of the decoloring device together with other devices may exceed an upper limit. If a power consumption value exceeds the upper limit in an environment where the decoloring device is installed, a power supply to a device including the decoloring device may malfunction.

DETAILED DESCRIPTION

In general, according to one embodiment, a power control device includes a heating section, an input section, and a control section. The heating section is configured to heat an object. The input section is configured to receive a power consumption value. The control section is configured to control the heating section so that a total power value obtained by adding a power consumption value of the heating section and the power consumption value received by the input section does not exceed a predetermined power value.

Hereinafter, an embodiment will be described with reference to the drawings.

Figure 1:
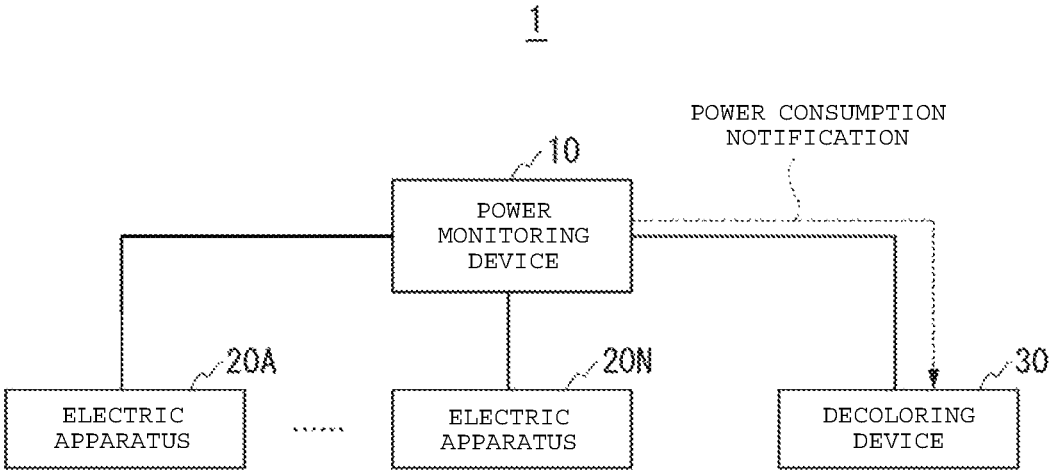
FIG. 1 is a block diagram illustrating a power monitoring system including a decoloring device according to an embodiment.

FIG. 1 illustrates a power monitoring system 1 including a decoloring device 30 according to an embodiment. The power monitoring system 1 includes a power monitoring device 10, electric apparatuses 20A, . . . 20N, and a decoloring device 30. In the following description, the electric apparatuses 20A, . . . 20N are collectively referred to as the electric apparatuses 20. The power monitoring system 1 includes N electric apparatuses 20. The electric apparatuses 20 are not limited to N electric apparatuses and may be any arbitrary number of electric apparatuses.

The electric apparatuses 20 and the decoloring device 30 consume power by drawing current in a range up to an upper limit current value. The power monitoring system 1 cuts off the power supply when a value of the current supplied to the electric apparatuses 20 and the decoloring device 30 reaches the upper limit current value.

The upper limit current value is a specified amperage in an environment in which the power monitoring device 10, the electric apparatuses 20, and the decoloring device 30 exist. The specified amperage is the maximum value of a current that may be consumed per unit time in the environment.

The power monitoring device 10 monitors power that is consumed by the electric apparatuses 20 and the decoloring device 30. The power monitoring device 10 is connected to the electric apparatuses 20 and the decoloring device 30. The power monitoring device 10 detects a power value that is consumed by the electric apparatuses 20 and the decoloring device 30. The power monitoring device 10 stores a combined value of the detected power values. For example, the power monitoring device 10 may be configured as a smart meter.

The power monitoring device 10 transmits a power consumption notification. The power consumption notification indicates power that is consumed by electric apparatuses other than the decoloring device 30. In the embodiment, the power consumption notification indicates a power value that is consumed by the electric apparatuses 20. The power consumption notification is received by the decoloring device 30.

In the embodiment, the power consumption notification is transmitted from the power monitoring device 10 to the decoloring device 30. However, the power consumption notification may be transmitted from any of the electric apparatuses 20 to the decoloring device 30. Furthermore, the decoloring device 30 may request the power consumption amount of the electric apparatuses 20, and may receive the power consumption amount.

The electric apparatuses 20 are disposed in the same environment (e.g., same electric power grid) as the decoloring device 30. The electric apparatus 20A is a device consuming power. The electric apparatus 20A may be an arbitrary device. For example, the electric apparatus 20A may be an image forming apparatus. The image forming apparatus may be one that forms an image on a paper sheet using decoloring toner that is a decolorable colorant.

The decoloring device 30 decolors the image formed by the decolorable colorant. Thus, the decoloring device 30 causes the paper sheet to be in a reusable state. Moreover, in the embodiment, an object on which the image is formed and which is decolored by the decoloring device 30 is a paper sheet that is used for a Plain Paper Copier (PPC). The paper sheet is a sheet-shaped paper sheet (paper, film, and the like) on which the image (letters, pictures, figures, and the like) is formed by colorant that is capable of being decolored.

The colorant is toner, ink, or the like for forming the image on the paper sheet. Hereinafter, the colorant is described as thermally decolored toner in which colors are decolored by being heated to a temperature higher than a fixing temperature, but is not limited to this. For example, the colorant may be ink that is decolored by a chemical process and the like using a solvent.

Figure 2:
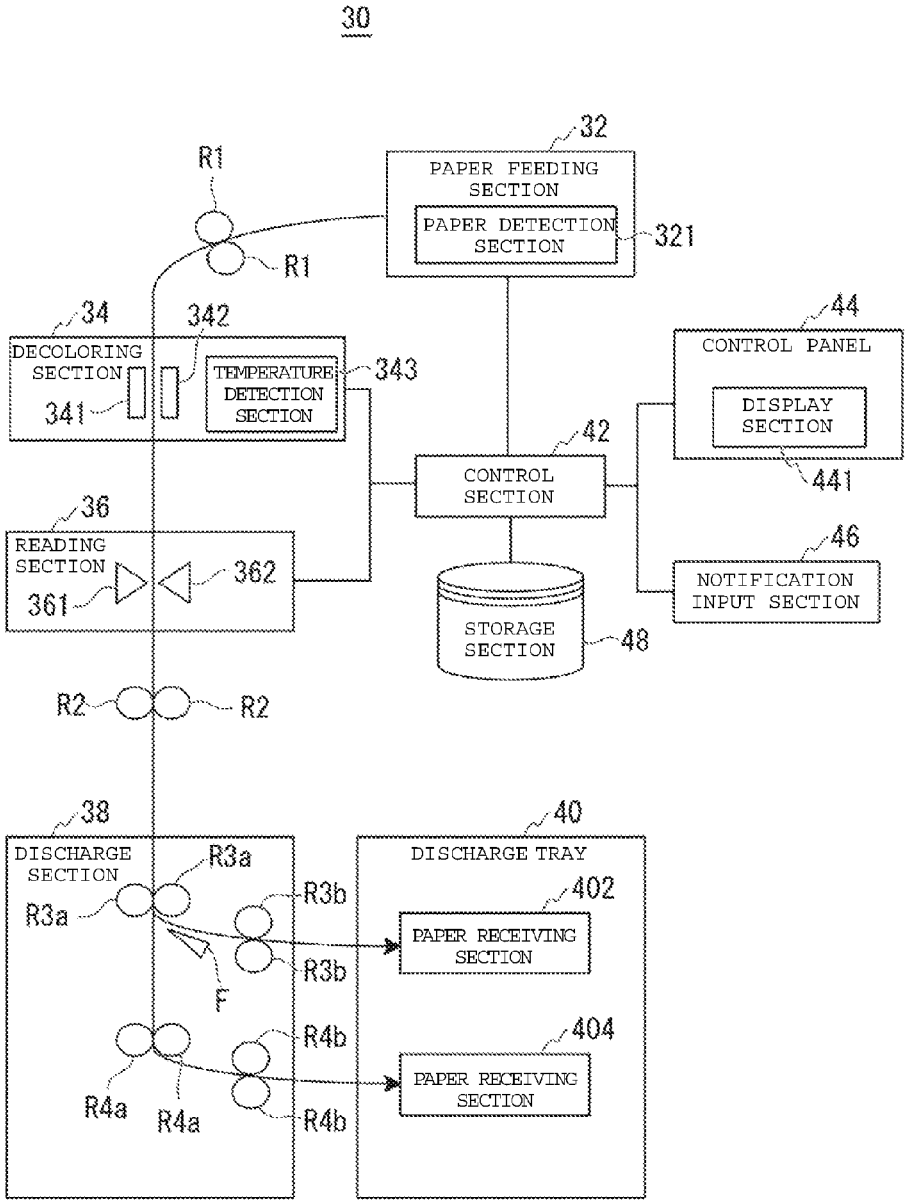
FIG. 2 is a block diagram illustrating the decoloring device according to the embodiment.

FIG. 2 is a block diagram illustrating a configuration of the decoloring device 30. The decoloring device 30 performs a decoloring process on the paper sheet disposed in a paper feeding section 32. The decoloring device 30 includes the paper feeding section 32, a decoloring section 34, a reading section 36, a discharge section 38, and a discharge tray 40.

The decoloring device 30 includes a plurality of transport rollers R1, R2, R3*a*, R3*b*, R4*a*, and R4*b*. Each of the transport rollers R1, R2, R3*a*, R3*b*, R4*a*, and R4*b* is driven by a motor (not illustrated). The motor is driven according to control of a control section 42 and the paper sheet is transported by the transport rollers R1, R2, R3*a*, R3*b*, R4*a*, and R4*b*.

The paper feeding section 32 includes a table on which the paper sheet is disposed. The paper sheet disposed on the paper feeding section 32 is fed to the decoloring section 34 through feeding rollers (not illustrated) and the transport rollers R1. The paper feeding section 32 includes a paper detection section 321. The paper detection section 321 detects that the paper sheet is disposed on the tray. The paper detection section 321 outputs a result to the control section 42, described below.

The paper sheet is supplied to the decoloring section 34 through the transport rollers R1. The decoloring section 34 decolors (using a decoloring operation) the image formed on the paper sheet. At this time, the decoloring section 34 heats (using heating section) the paper sheet.

The decoloring section 34 includes a front surface heater 341 and a back surface heater 342. The front surface heater 341 and the back surface heater 342 may heat the paper sheet by induction heating. The front surface heater 341 and the back surface heater 342 may heat the paper sheet by supplying inverter-controlled power to a lamp.

The front surface heater 341 heats the front surface of the fed paper sheet to a predetermined temperature. The predetermined temperature is a temperature at or above which the image is decolored. Thus, the front surface heater 341 decolors the image formed on the front surface of the paper sheet. The back surface heater 342 heats the back surface of the fed paper sheet to a predetermined temperature. Thus, the back surface heater 342 decolors the image formed on a back surface of the paper sheet.

The decoloring section 34 is configured to change the power consumption per unit time. Thus, the decoloring section 34 is configured to adjust a heating amount per unit time. For example, a current supplied to the decoloring section 34 is adjusted by pulse width modulation (PWM) control.

Moreover, the decoloring section 34 is described as including two heaters including the front surface heater 341 and the back surface heater 342, but is not limited to such. For example, the decoloring section 34 may include just one of the front surface heater 341 and the back surface heater 342.

The decoloring section 34 includes a temperature detection section 343 configured to detect the temperature in a decoloring operation. The temperature detection section 343 may detect the temperature of the front surface heater 341 and the back surface heater 342. The temperature detection section 343 may detect the temperature of the paper sheet. The temperature detection section 343 may be configured with a thermistor. The temperature detection section 343 supplies detected temperature information to the control section 42. The reading section 36 reads the image formed on the paper sheet supplied through the decoloring section 34. The reading section 36 may be an image sensor, such as an image scanner. The reading section 36 outputs the information (image information) indicating the image of the paper sheet that is read, to the control section 42. The image information is information indicating a decolored state of the image of the paper sheet passing through the decoloring section 34.

The reading section 36 includes a front surface image sensor 361 and a back surface image sensor 362. The front surface image sensor 361 reads the image of the front surface of the paper sheet passing through the decoloring section 34. The back surface image sensor 362 reads the image of the back surface of the paper sheet passing through the decoloring section 34.

The reading section 36 is described herein as including two image sensors, namely the front surface image sensor 361 and the back surface image sensor 362, but is not limited to such. For example, the reading section 36 may include just one of the front surface image sensor 361 and the back surface image sensor 362.

The discharge section 38 discharges the paper sheet supplied from the reading section 36 through the rollers R2 to the discharge tray 40. The discharge section 38 includes a switching mechanism that switches a discharging destination of the paper sheet according to the control of the control section 42. The switching mechanism includes the rollers R3*a*, a flapper F, and the rollers R3*b*. Furthermore, the switching mechanism includes the rollers R4*a* and the rollers R4*b*. The flapper F switches the discharging destination of the paper sheet passing through the rollers R3*a*. The flapper F switches the discharging destination of the paper sheet between the rollers R3*b* and the rollers R4*a*.

If the discharging destination of the paper sheet is the rollers R3*b*, the discharge section 38 discharges the paper sheet to a paper receiving section 402 of the discharge tray 40 through the rollers R3*b*. If the discharging destination of the paper sheet is the rollers R4*a*, the discharge section 38 discharges the paper sheet to a paper receiving section 404 of the discharge tray 40 through the rollers R4*a* and the rollers R4*b*.

The discharge tray 40 includes a plurality of paper receiving sections on which the paper sheets discharged from the discharge section 38 are stacked. In the embodiment, the discharge tray 40 includes two paper receiving sections 402 and 404. The paper sheet that is reusable is supplied to the paper receiving section 402. The reusable paper sheet is a paper sheet in which the decoloring is completed. The paper sheet that is not capable of being reused is supplied to the paper receiving section 404. The paper sheet that is not capable of being reused is a paper sheet in which the image remains after the decoloring operation. The discharge tray 40 is not limited to two paper receiving sections, and may include more than two paper receiving sections.

The decoloring device 30 also includes the control section 42, a control panel 44, a notification input section 46, and a storage section 48.

The control panel 44 includes a display section 441. The display section 441 displays various kinds of information according to the control of the control section 42. The display section 441 may be a liquid crystal panel. The display section 441 displays that the decoloring device 30 is in a power limiting mode as an operation mode of the decoloring device 30. The power limiting mode is an operation mode that limits the power consumption of the decoloring device 30.

The display section 441 may have a built-in touch panel. Thus, the display section 441 is capable of receiving inputs from a user, e.g., an upper limit current value input from the user as described below.

The notification input section 46 receives as input the power consumption notification from the power monitoring device 10. The notification input section 46 may be a communication interface circuit communicating with the power monitoring device 10. The notification input section 46 receives the power consumption notification for each predetermined period. The notification input section 46 outputs the received power consumption notification to the control section 42.

The control section 42 controls each section of the decoloring device 30. The control section 42 may be a processor, such as a Central Processing Unit (CPU). The control section 42 may be implemented using Large Scale Integration (LSI) and the like. The control section 42 may be an Application Specific Integrated Circuit (ASIC).

The control section 42 controls a motor (not illustrated) and drives the rollers R1, R2, R3*a*, R3*b*, R4*a*, and R4*b*. The control section 42 controls start and stop of the transportation, as well as a transportation speed of the paper sheet. The control section 42 controls timing when the paper sheet is supplied to the decoloring section 34. Thus, the control section 42 controls the number of paper sheets that are continuously decolored by the decoloring section 34. Furthermore, the control section 42 intermittently supplies the paper sheet to be decolored to the decoloring section 34.

The control section 42 controls the decoloring section 34 and heats the paper sheet. At this time, the control section 42 controls the heating amount of the decoloring section 34, based on a temperature that is detected by the temperature detection section 343. Therefore, the control section 42 controls the temperature of the paper sheet to be a predetermined temperature or higher. For example, the control section 42 adjusts the heating amount of the decoloring section 34 by PWM control.

The control section 42 controls the power consumption of the decoloring section 34 so that the total power consumption of the power monitoring system 1 does not exceed the upper limit current value. The control section 42 may control the maximum value of the number of paper sheets to be continuously decolored by the decoloring section 34. The control section 42 may control the maximum power consumption value of the decoloring section 34. Moreover, a process to control the power consumption of the decoloring section 34 by the control section 42 is described below.

If the power consumption of the decoloring section 34 is controlled, the temperature of the paper sheet may be lower than the predetermined temperature. If the temperature detected by the temperature detection section 343 is lower than the predetermined temperature, the control section 42 suspends the transportation of the paper sheet to the decoloring section 34. Thus, the control section 42 suspends the decoloring operation of the decoloring section 34. If the decoloring operation is suspended, the control section 42 may display "limiting power consumption" or "WAIT" in the display section 441.

The control section 42 controls the reading section 36, and controls the reading section 36 to read the image on the paper sheet. The control section 42 determines whether or not the image is formed on the paper sheet based on the image information that is read by the reading section 36. The control section 42 controls the flapper F based on the determination result of whether or not the image is formed on the paper sheet. If the image is not formed on the paper sheet, the control section 42 controls the flapper F to supply the paper sheet to the paper receiving section 402. If the image is formed on the paper sheet, the control section 42 controls the flapper F to supply the paper sheet to the paper receiving section 404.

The storage section 48 is a recording medium that records various information items. The control section 42 reads the information from the storage section 48. The storage section 48 stores a power control program that is configured for execution by the control section 42.

Figure 3:
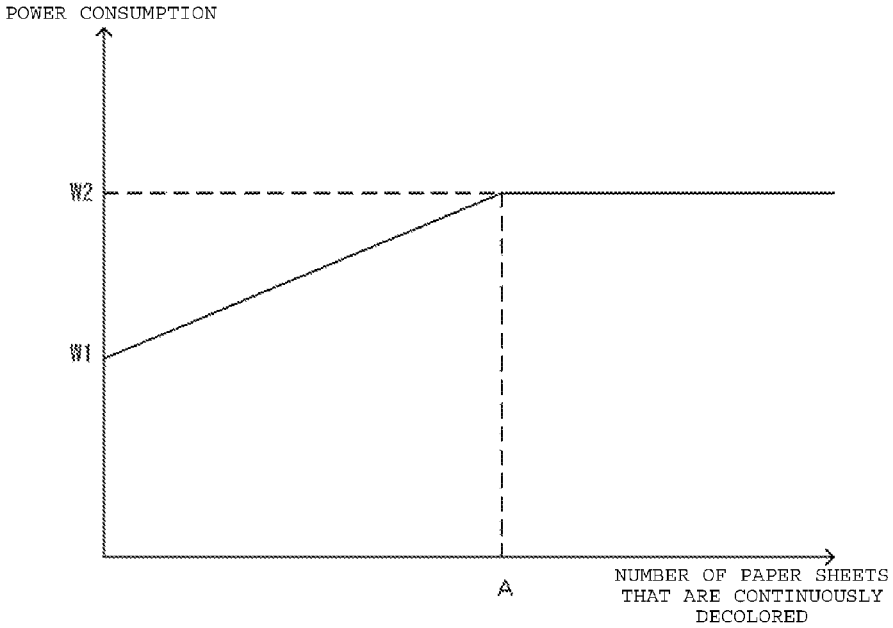
FIG. 3 is a view illustrating a relationship between the number of paper sheets that are continuously decolored by the decoloring device and power consumption of a decoloring section.
Figure 4:
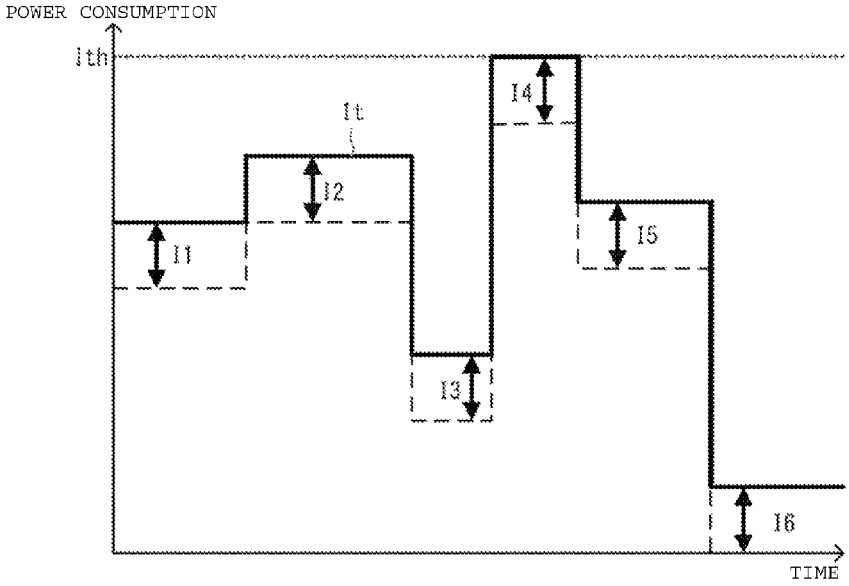
FIG. 4 is a view illustrating a temporal change of an entire current consumption and power consumption of the decoloring section in the power monitoring system.
Figure 5:
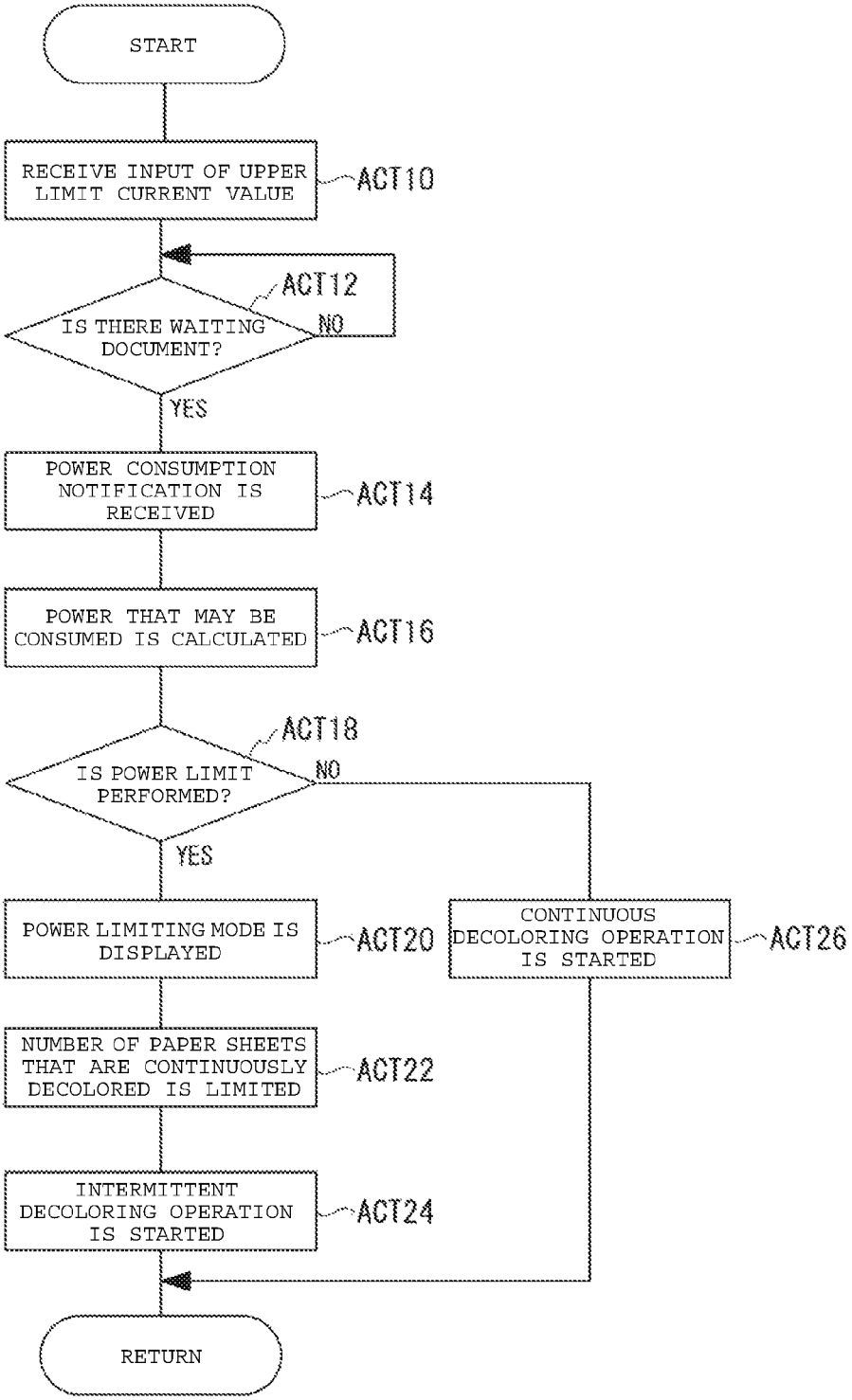
FIG. 5 is a flowchart illustrating a method of controlling the power consumption of the decoloring section according to an embodiment.

A process for controlling the power consumption of the decoloring section 34 by the decoloring device 30 will be described. FIG. 3 is a view illustrating a relationship between the number of paper sheets that are continuously decolorable at a predetermined time and the power consumption of the decoloring section 34. FIG. 4 illustrates a temporal change of the power consumption of the entirety of the power monitoring system 1. FIG. 5 is a flowchart illustrating a method of controlling the power consumption of the decoloring section 34.

As illustrated in FIG. 3, the power consumption of the decoloring section 34 gradually increases from W1 as the number of the paper sheets that are continuously decolored increases from 0 to a predetermined number A. If the number of the continuously decolored paper sheets reaches the number A, the power consumption of the decoloring section 34 reaches the maximum value W2. The storage section 48 stores table data indicating a relationship between the number of the continuously decolored paper sheets and the power consumption of the decoloring section 34.

The control section 42 controls the power consumption of the decoloring section 34 with reference to the table data stored in the storage section 48. At this time, the control section 42 reads the power control program stored in the storage section 48 and performs the process illustrated in FIG. 5.

First, the control section 42 receives an input of the upper limit current value (ACT10). The control section 42 receives the input through the touch panel of the display section 441.

Next, the control section 42 determines whether or not there is a waiting document (ACT12). The control section 42 refers to a detection result obtained by the paper detection section 321. If there is the waiting document (ACT12: YES), the method proceeds to ACT14.

Next, the decoloring device 30 receives the power consumption notification (ACT14). The control section 42 receives the power consumption notification through the notification input section 46.

Next, the control section 42 calculates the power that may be consumed (ACT16). The control section 42 calculates current consumption using the power consumption indicated by the power consumption notification received in ACT14. The control section 42 calculates a difference between the calculated current consumption and the upper limit value input in ACT10. The control section 42 calculates the power that may be consumed by using a current value of the difference that is obtained by the calculation.

Next, the control section 42 determines whether or not power limit is performed (ACT18). If the power that may be consumed is smaller than W2, the current consumption of the entirety of the power monitoring system 1 exceeds the specified amperage if the power limit of the decoloring section 34 is not performed. The control section 42 determines that the power limit is performed if the power that may be consumed calculated in ACT16 is smaller than W2. If the power that may be consumed is smaller than W2 (ACT18: YES), method proceeds to ACT20. If the power that may be consumed is not smaller than W2 (ACT18: NO), the method proceeds to ACT26.

In ACT26, the control section 42 continuously starts the decoloring operation. At this time, the control section 42 configures the number of paper sheets that are continuously decolored to be A. Furthermore, the control section 42 controls the rollers R1 to continuously supply the paper sheet to the decoloring section 34. Thus, the control section 42 may configure the power consumption of the decoloring section 34 to be W2.

In ACT20, the control section 42 displays that the decoloring device 30 is in the power limiting mode in the display section 441 (ACT20). Thus, the decoloring device 30 presents to the user that the decoloring operation is limited.

Next, the control section 42 starts the limit of the number of paper sheets that are continuously decolored (ACT22). The control section 42 configures the number of paper sheets that are continuously decolored in the decoloring section 34 to be smaller than A.

Next, the control section 42 intermittently starts the decoloring operation (ACT24). The control section 42 drives the decoloring section 34 with power consumption that is lower than W2. Furthermore, the control section 42 controls the rollers R1 so as to intermittently supply the paper sheet to the decoloring section 34. The control section 42 monitors a temperature value that is detected by the temperature detection section 343. The control section 42 does not supply the paper sheet to the decoloring section 34 if the monitored temperature value is not a predetermined temperature or higher. That is, the control section 42 suspends the supply of the paper sheet to the decoloring section 34. The control section 42 supplies the paper sheet to the decoloring section 34 if the temperature value is the predetermined temperature or higher.

The decoloring device 30 may decrease the power consumption of the decoloring section 34 per unit time if the number of paper sheets that are continuously decolored is limited. As a result, as illustrated in FIG. 4, the control section 42 may configure the power consumption of the decoloring section 34 to be constant as indicated by symbols I1 to I6. Thus, the control section 42 may operate the decoloring section 34 so that the total current consumption of the power monitoring system 1 does not exceed the upper limit value.

According to the decoloring device 30 of the embodiment, the power consumption of the decoloring section 34 is controlled so that the current consumption of the entirety of the power monitoring system 1 does not exceed the upper limit value. Therefore, even if the upper limit value is a low value according to desire of the user, it is possible to prevent the current consumption from exceeding the upper limit value by driving the decoloring section 34.

Furthermore, even if the decoloring device 30 is disposed in an electrical grid in which many electric apparatuses 20 are also provided, it is possible to prevent the total current consumption from exceeding the upper limit value. Thus, the user may install the decoloring device 30 without regard to the upper limit value and the current consumption of the decoloring device 30.

The decoloring operation by the decoloring device 30 may not be performed immediately after the paper sheet is disposed in the paper feeding section 32. That is, the decoloring operation is not impaired even if the decoloring operation is performed at some other time. According to the decoloring device 30, it is possible to limit the decoloring operation according to this recognition.

Furthermore, it is possible to input the upper limit value through user input. Thus, it is possible to limit the decoloring operation and it is possible to increase customizability.

Figure 6:
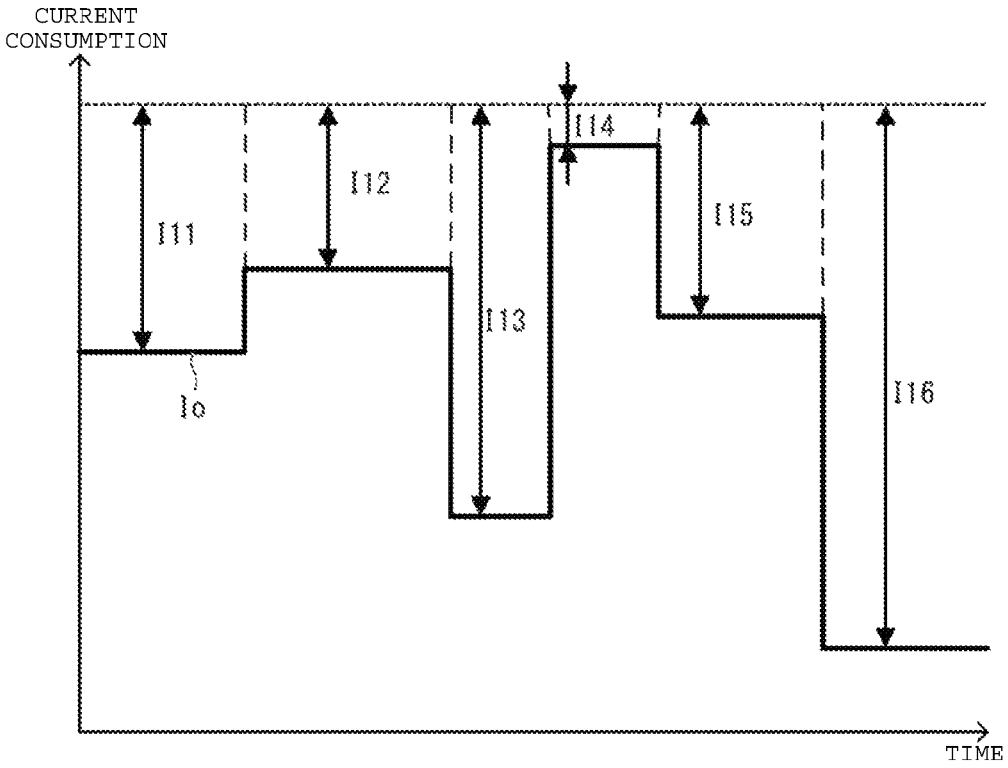
FIG. 6 is a view illustrating a temporal change of current consumption of electric apparatuses and a current that may be consumed by the decoloring section.
Figure 7:
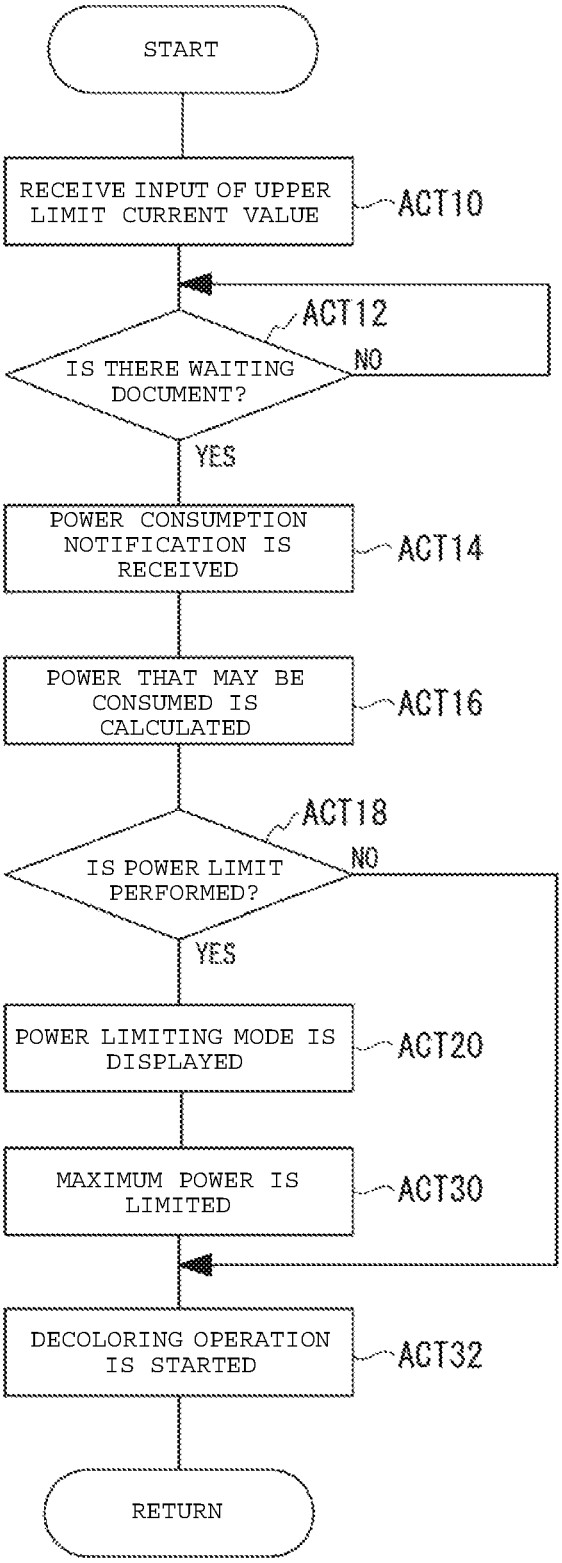
FIG. 7 is a flowchart illustrating another method of controlling the power consumption of the decoloring section according to an embodiment.

Another method for controlling the power consumption of the decoloring section 34 by the decoloring device 30 will be described. FIG. 6 illustrates a temporal change between the power consumption of the electric apparatus 20 and the power that may be consumed by the decoloring section 34. FIG. 7 is a flowchart illustrating another method of controlling the power consumption of the decoloring section 34. The control section 42 reads the power control program stored in the storage section 48 and performs the process illustrated in FIG. 7.

The control section 42 performs the processes of ACT10 to ACT20 as described with reference to FIG. 5. Next, the control section 42 limits the maximum power of the decoloring section 34 (ACT30). The control section 42 calculates a difference between a current corresponding to the power consumption notification received in ACT14 and the upper limit value. The control section 42 sets the power corresponding to the current value of the calculated difference as the maximum power of the decoloring section 34.

Thereafter, the control section 42 limits the maximum power of the decoloring section 34 and begins the decoloring operation (ACT32). If the maximum power is limited, as illustrated in FIG. 6, the control section 42 may limit the maximum current consumption of the decoloring section 34 as indicated by the symbols I1 to I6 with respect to a current value Io corresponding to the power that is notified by the power consumption notification. Furthermore, the control section 42 may operate the decoloring section 34 so that the total current consumption of the power monitoring system 1 does not exceed Ith.

According to at least one embodiment described above, the current consumption of the entirety of the power monitoring system 1 is controlled to not exceed the upper limit value. Therefore, even if the upper limit value is a low value as input by the user, it is possible to prevent the current consumption from exceeding the upper limit value by driving the decoloring section 34.

Furthermore, it is possible to increase the power using in the decoloring operation in a range in which the total current consumption of the power monitoring system 1 does not exceed the upper limit value.

Moreover, if the current value Io corresponding to the power value that is notified by the power consumption notification is large, as indicated by a symbol 114, the maximum current consumption of the decoloring section 34 is decreased. In this case, the temperatures of the front surface heater 341 and the back surface heater 342 are decreased. The control section 42 suspends the decoloring operation if the temperatures of the front surface heater 341 and the back surface heater 342 are below the predetermined temperatures. At this time, the control section 42 displays "during power consumption limit" or "WAIT" in the display section 441.

The decoloring device 30 according to the embodiment described above may limit the number of paper sheets that are continuously decolored in the decoloring section 34, or may limit the maximum power of the decoloring section 34. The control section 42 may switch which one of the number of paper sheets that are continuously decolored and the maximum power is limited by receiving an input from the user through a touch panel mechanism of the display section 441.

The embodiment described above is described for the decoloring section 34 as the heating section, but is not limited thereto. The heating section may be one that is configured to change the power consumption and heats the object. The heating section may be a boiler mechanism for boiling water. In this case, according to the embodiment, it is possible to control the boiler mechanism so that a power value that is obtained by adding a power consumption of the boiler mechanism and the power of the power consumption notification does not exceed the upper limit value.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A decoloring device, comprising:

a decoloring section configured to decolor an image;

an input section configured to receive a power consumption value; and a control section configured to control the decoloring section so that a total power value obtained by adding a power consumption value of the decoloring section and the power consumption value received by the input section does not exceed a predetermined power value.

2. The device according to claim 1, wherein the decoloring section is configured to heat a paper sheet on which an image is formed by colorant that is decolorable by heating.

3. The device according to claim 2, wherein the control section is configured to limit the number of paper sheets that are continuously decolored within a predetermined time period.

4. The device according to claim 2, wherein the control section is configured to limit the power consumption of the decoloring section.

5. The device according to claim 1, wherein the input section is configured to receive the power consumption value from a power monitoring device connected to a plurality of devices including the power control device.

6. The device according to claim 1, wherein the predetermined power value is a value that is input by a user.

7. The device according to claim 1, further comprising:

a display section configured to display that the power consumption of the decoloring section is limited.

8. The device according to claim 1, wherein the power control device is disposed in an image forming apparatus.

* * * * *